United States Patent [19]

Jeschke

[11] Patent Number: 4,610,201

[45] Date of Patent: Sep. 9, 1986

[54] PRINTING UNIT WITH SHORT INKING DEVICE

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 804,226

[22] Filed: Dec. 2, 1985

Related U.S. Application Data

[63] Continuation of Ser. No. 640,505, Aug. 13, 1984, abandoned.

[30] Foreign Application Priority Data

Aug. 13, 1983 [DE] Fed. Rep. of Germany ..... 3329331

[51] Int. Cl.[4] ..... B41F 7/02

[52] U.S. Cl. ..... 101/217; 101/142; 101/DIG. 28

[58] Field of Search ..... 101/142, 148, 154, 169, 101/177, 206, 207, 217, 350, 365, 366, DIG. 28, 179, 180, 182, 184, 185, 218, 220, 221, 270

[56] References Cited

U.S. PATENT DOCUMENTS

| | | | |
|---|---|---|---|
| 2,534,320 | 12/1950 | Taylor | 101/169 |
| 3,203,346 | 8/1965 | Norton et al. | 101/DIG. 28 |
| 4,287,827 | 9/1981 | Warner | 101/148 X |
| 4,373,442 | 2/1983 | Dahlgren et al. | 101/148 X |
| 4,421,027 | 12/1983 | Fischer | 101/DIG. 28 |
| 4,428,291 | 1/1984 | Dorow | 101/350 |
| 4,441,423 | 4/1984 | Germann | 101/177 X |
| 4,509,424 | 4/1985 | Germann | 101/DIG. 28 |

FOREIGN PATENT DOCUMENTS

| | | | |
|---|---|---|---|
| 0070484 | 1/1983 | European Pat. Off. | 101/350 |
| 2657610 | 6/1978 | Fed. Rep. of Germany | 101/217 |
| 2853814 | 6/1979 | Fed. Rep. of Germany | 101/350 |

*Primary Examiner*—Edgar S. Burr
*Assistant Examiner*—John A. Weresh
*Attorney, Agent, or Firm*—Herbert L. Lerner; Laurence A. Greenberg

[57] ABSTRACT

A printing unit with a short inking unit, the printing unit having mutually engageable impression, blanket and plate cylinders and at least one applicator roller having a size comparable to that of the cylinders for feeding both dampening medium and ink includes an inking cylinder, the inking cylinder and the plate cylinder being disposed relative to one another and to the blanket cylinder in a manner that the blanket cylinder is selectively engageable alternatively with one of the inking cylinders and the plate cylinder, the blanket cylinder being coverable selectively by a blanket and a rubber block, the inking cylinder having a ductor blade engageable therewith, the applicator roller being separated from the inking cylinder in a condition of the printing unit wherein the blanket cylinder is covered by the rubber block and is in direct cooperative engagement with the inking cylinder.

2 Claims, 4 Drawing Figures

PRINTING UNIT WITH SHORT INKING DEVICE

This application is a continuation of application Ser. No. 640,505 filed Aug. 13, 1984, now abandoned.

The invention relates to a printing unit with a short inking device, the printing unit, more particularly, having mutually engageable impression, blanket and plate cylinders and at least one applicator roller having the same size as that of the cylinders for feeding both dampening liquid and ink.

Offset printing machines with a short inking unit have been known heretofore, for example, from European Patent No. 0 065 138. Dampening medium and highly viscous ink are fed from a single application roller having the same size as that of the printing unit cylinders to the plate cylinder. Printing units of this general type are able to be used for offset printing of high quality. These high quality demands are not applied, however, to many printing jobs. It is often sufficient to use less expensive flexographic printing instead of offset printing.

It is therefore an object of the invention to provide a printing unit with a short inking device which is capable of operating with low-viscosity and quickly drying ink both after an offset printing operation as well as after a flexographic printing operation.

With the foregoing and other objects in view, there is provided, in accordance with the invention, a printing unit with a short inking unit, the printing unit having mutually engageable impression, blanket and plate cylinders and at least one applicator roller having a size comparable to that of the cylinders for feeding both dampening medium and ink, comprising an inking cylinder, the inking cylinder and the plate cylinder being disposed relative to one another and to the blanket cylinder in a manner that the blanket cylinder is selectively engageable alternatively with one of the inking cylinders and the plate cylinder, the blanket cylinder being coverable selectively by a blanket and a rubber block, the inking cylinder having a ductor blade engageable therewith, the applicator roller being separated from the inking cylinder in a condition of the printing unit, wherein the blanket cylinder is covered by the rubber block and is in direct cooperative engagement with the inking cylinder.

The printing unit according to the invention can be converted from one to the other printing operation, depending upon the printed matter to be processed and the quality demanded. High gloss prints on art paper such as enameled or chromo paper would, for example, be processed in the offset printing condition or mode of the printing unit. Foils or packaging material, on the other hand, print with high speed in the flexographic printing mode. Conversion of the machine from the one printing mode to the other can be effected with relatively few manipulations i.e. without any great consumption of time. A printing machine with printing units, according to the invention, thereby offer the possibility of adopting the economically more advantageous one of the two printing modes for each printing order.

In accordance with another feature of the invention, the inking cylinder has an outer cylindrical surface which is smoothly polished.

In accordance with an additional feature of the invention, the inking cylinder has an outer cylindrical surface which is screened.

In accordance with a further feature of the invention, the ductor blade is constructed as a surface ductor blade.

In accordance with still another feature of the invention, the ductor blade is constructed as an edge ductor blade.

In accordance with still an additional feature of the invention, the applicator roller cooperatively engages a smooth dampening-medium transport roller having a chromium outer cylindrical surface, and a chromium distributor roller having a rough outer cylindrical surface engaged with the applicator roller between the applicator roller and the plate cylinder as viewed in rotary direction thereof.

In accordance with still a further feature of the invention, there is provided another applicator roller having a size comparable to that of the cylinders, the other applicator roller being connected via an ink distributor cylinder with the first-mentioned applicator roller.

In accordance with yet another feature of the invention, the inking cylinder has a smoother polished outer cylindrical surface, and wherein the surface ductor blade tangentially engages the outer cylindrical surface of the inking cylinder, the surface ductor blade having an edge projecting a distance a beyond a point of tangency of the surface ductor blade with the inking cylinder, the inking unit including an ink duct and a dipping roller immersed therein, the dipping roller being located forward of the surface ductor roller for transporting ink via the inking cylinder to the surface ductor blade.

In accordance with a concomittant feature of the invention, the inking cylinder has a smoothly polished outer cylindrical surface, and wherein the surface ductor blade tangentially engages the outer cylindrical surface of the inking cylinder, the surface ductor blade having an edge projecting a distance a beyond a point of tangency of the surface ductor blade with the inking cylinder, the inking unit including an ink reservoir disposed beneath the ductor blade.

Other features which are considered as characteristic for the invention are set forth in the appended claims.

Although the invention is illustrated and described herein as embodied in a printing unit with a short inking unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
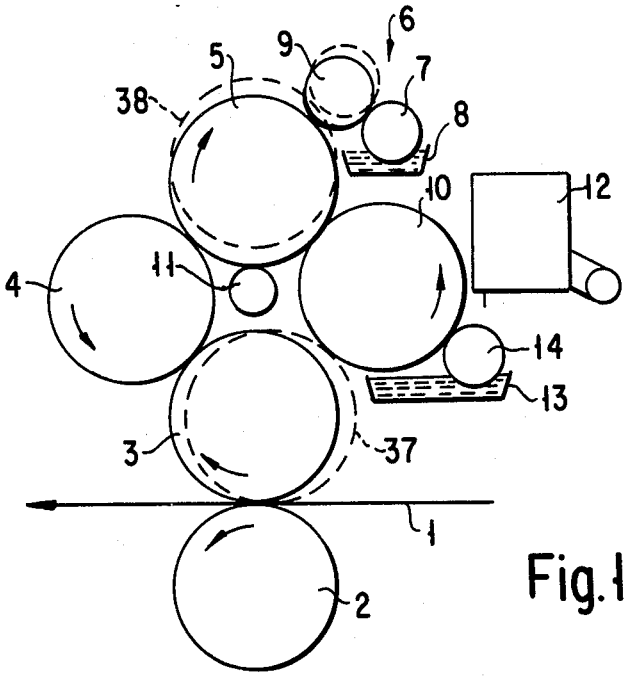
FIG. 1 is an elevational diagrammatic view of a printing unit convertible from offset to flexographic printing, the printing unit having an applicator roller and being constructed in accordance with the invention.

Referring now to the drawing and first, particularly, to FIG. 1 thereof, there is shown therein a printing unit having an impression cylinder 2 and a blanket cylinder 3 having a nip or printing gap therebetween through which printing material 1 is passed. A plate cylinder 4 on which an offset printing plate is clamped engages the blanket cylinder 3. An applicator roller 5 having the size of a cylinder transfers both dampening medium as well as ink to the plate cylinder 4. A dampening unit 6 feeding dampening medium to the applicator roller 5 is formed of a dipping roller or ductor 7, a dampening medium tank 8 and a dampening-medium transport roller 9 having a chromium jacket or casing. Both the applicator roller 5 and the dipping roller 7 have a yielding or elastic covering. As viewed in rotary direction of the applicator roller 5, an inking cylinder 10 is provided behind the dampening unit 6, the inking cylinder 10, in the illustrated embodiment, having the same diameter as that of the printing-unit cylinder 2 and 3, which is not necessarily mandatory, however. The inking cylinder 10 feeds the ink in finely metered form to the applicator roller 5. A chromium distributor roller 11 with a rough surface cooperates with the applicator roller 5 between the inking cylinder 10 and the plate cylinder 4. The chrome distributor roller 10 has the function of ensuring that ink and dampening medium are fed in emulsified form to the plate cylinder 4.

A ductor-blade unit 12 is pivotally and adjustably disposed against the inking cylinder 10. Below the ductor-blade unit 12 are an ink duct 13 and a dipping roller 14 immersed in the ink and feeding a pre-metered quantity of ink to the outer cylindrical surface of the inking cylinder 10. Fine metering is then effected by the ductor-blade unit.

In the control position of the printing unit shown in broken lines in FIG. 1, the printing unit is effective for offset printing operation. The ink duct 13 thus contains offset printing ink of very high viscosity. By clamping a rubber block or stereotype plate to the blanket cylinder 3 and adjusting the blanket cylinder into the position thereof shown in broken lines 37, operation of the printing unit in accordance with flexographic printing can be performed, provided, however, that the applicator roller 5 has been separated beforehand from the inking cylinder 10 and the plate cylinder 4 and placed in the position thereof represented by the broken lines 38. In addition, the ink duct 13 must, naturally, have been filled with flexographic printing ink of low viscosity.

Figure 2:
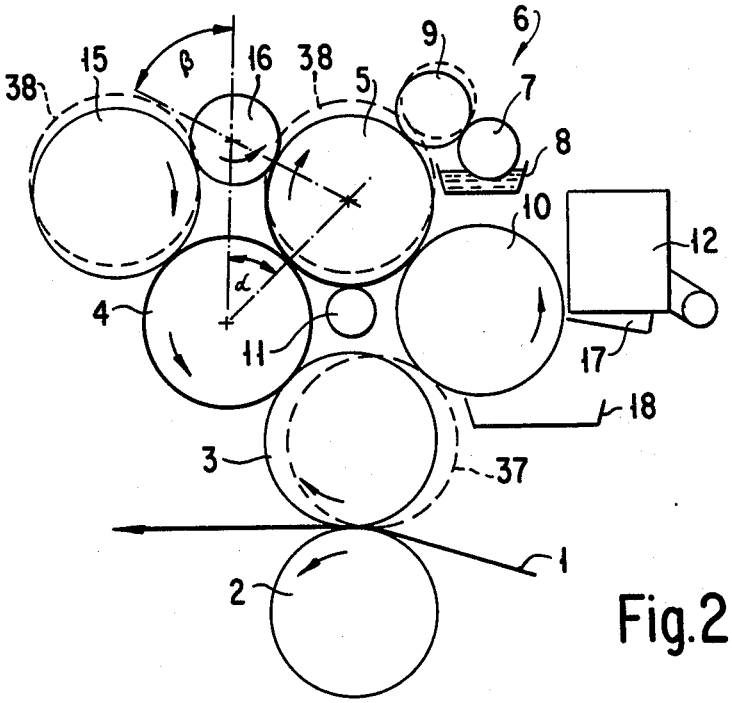
FIG. 2 is a view similar to that of FIG. 1 of another embodiment of the invention, but wherein the printing unit has two applicator rollers.

The embodiment shown in FIG. 2 likewise shows an impression cylinder 2 and a blanket cylinder 3, through the nip or printing gap therebetween, printing matter as a web or in the form of sheets is passed. The plate cylinder 4 cooperating with the blanket cylinder 3 is inked, however, not only by the applicator roller 5 having the size of a cylinder, but also by another applicator roller 15 having the size of a cylinder. Both applicator rollers 5 and 15 are connected by an ink distributor roller 16. Formation and arrangement of the dampening unit 6 with the ductor or dipping roller 7, the dampening medium tank 8 and the dampening-medium transport roller 9, and the chrome distributor roller 11 and the inking cylinder 10 correspond exactly to the embodiment of FIG. 1. The only difference is that the ductor blade unit 12 is provided at the underside thereof with an ink reservoir 17.

Furthermore, a collection vessel 18 is disposed below the inking cylinder 10.

In order to prevent stencilling, when the cylinder or rollers 4, 5, 15 and 16 are formed with equal diameters, the rotary axes thereof must be disposed perpendicularly to one another in order to ensure that the trouble spots do not travel or migrate. Even if smaller diameter of the ink distributor roller 16 is chosen, certain angular conditions must be maintained in order to prevent a trouble spot from shifting even minimally at most on an applicator roller. If, as in FIG. 2, the radius of the ink distributor roller 16 is selected to be only half as long as that of the applicator rollers 5 and 15, and an angle $\beta$ equal to 63.37° is to be maintained between the connecting line of the rotary axis of the plate cylinder 4 and the rotary axis of the ink distributor roller 16, as well as between the rotary axis of the applicator roller 5 and the rotary axis of the ink distributor roller 16, whereas the angle $\alpha$ formed by the connecting lines between the rotary axis of the plate cylinder 4 and the applicator roller 5 must equal 42.24° in order to attain the most desirable rolling conditions with respect to stencilling. Thus, the diameter of the ink distributor roller 16 can be varied throughout, provided that the mutual disposition of the four cylinders 4, 5, 15 and 16 experiences a suitable adjustment.

The printing unit in FIG. 2 is illustrated in the offset phase or condition thereof. If it is converted to flexographic printing, initially, the blanket cylinder 3 must have a rubber block clamped thereover and, furthermore, the blanket cylinder 3 must be separated from the plate cylinder 4 and brought into contact with the inking cylinder 10. The ink reservoir 17 is either cleansed of offset printing ink and newly filled with flexographic printing ink or is removed and replaced by another ink reservoir containing flexographic ink. The applicator rollers 5 and 15 are placed into the position 38 thereof represented by broken lines. Thereafter, they have no contact any longer with the plate cylinder 4, and the applicator roller 5, moreover, is separated from the inking cylinder 10. In this control condition, the printing unit shown in FIG. 2 operates in accordance with flexographic printing procedures.

The inking cylinder 10 in the two embodiments of a printing unit according to the invention, as shown in FIGS. 1 and 2, has a smoothly polished casing or jacket. Consequently, the metering of the ink film is performed by an edgewise disposed surface ductor-blade. In order to achieve a finely sensitive metering of the ink film over a wide area, this is the most advantageous embodiment of a short-type inking unit. It is also conceivable, however, that the inking cylinder 10 be formed as a screen roller and cooperate with an edge ductor blade operating in the same direction therewith or in opposite direction thereto.

Figure 3:
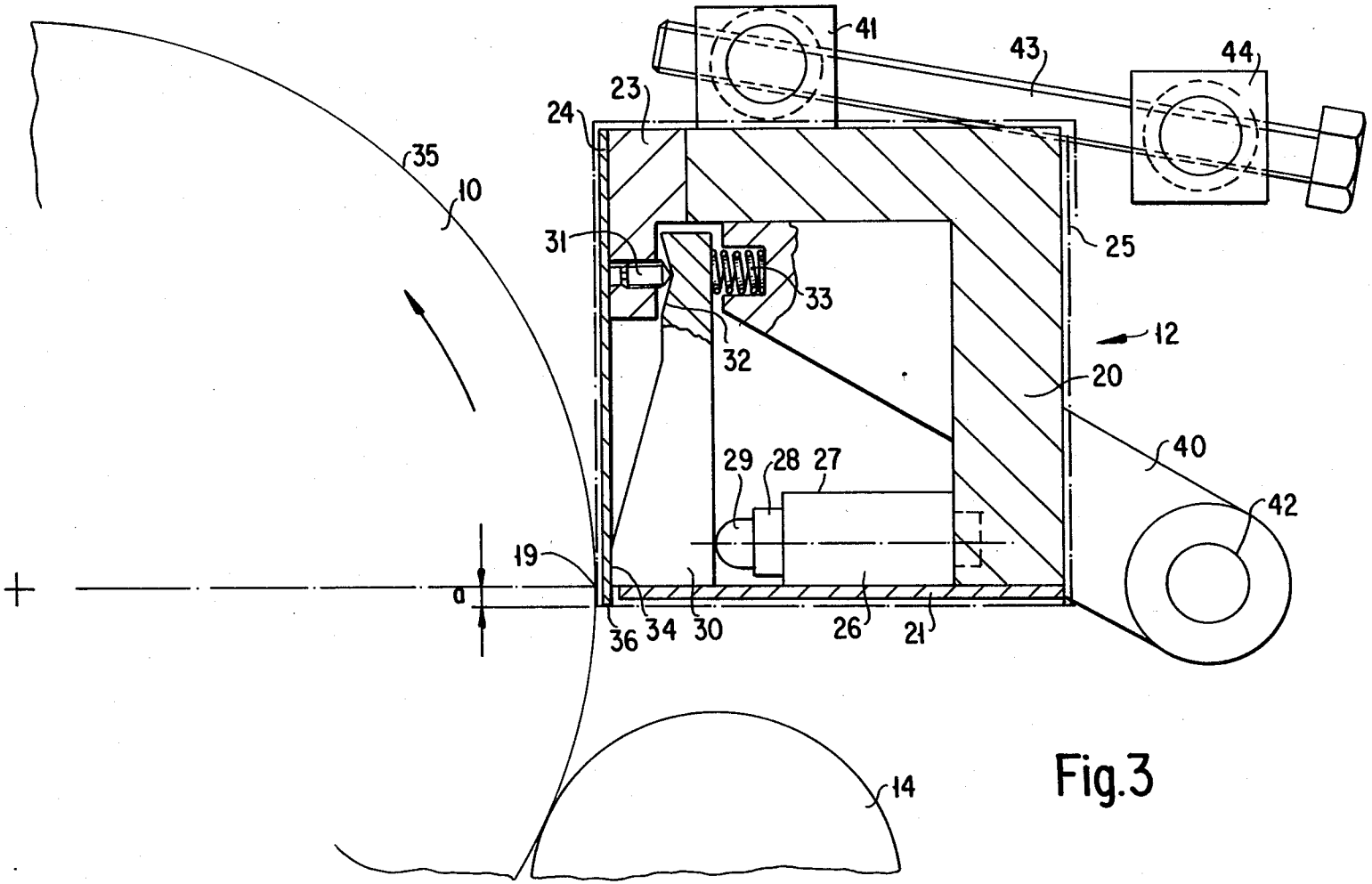
FIG. 3 is an enlarged fragmentary view of FIG. 1 showing, in combination, a ductor blade unit and a dipping roller forming part of the invention.
Figure 4:
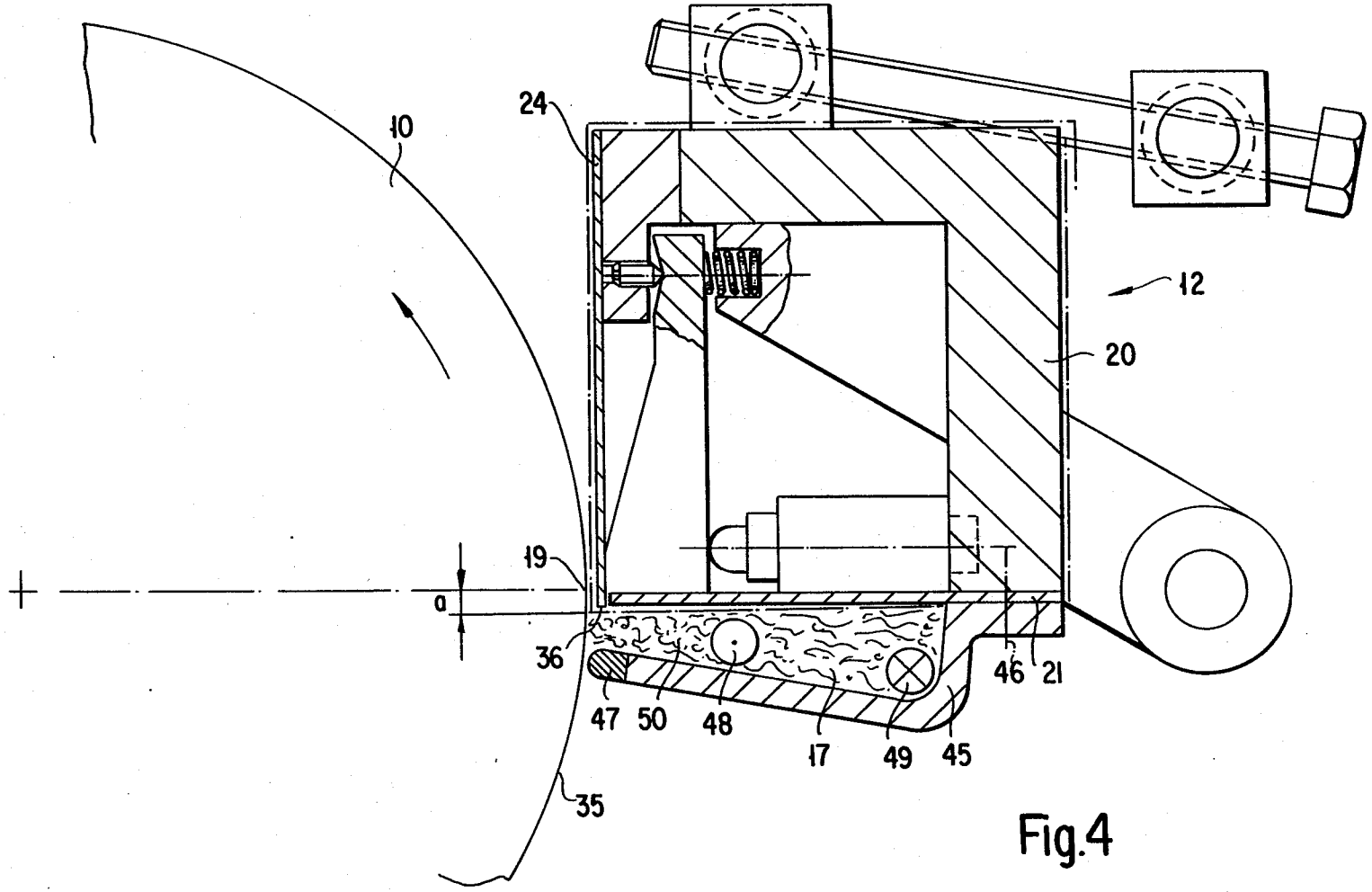
FIG. 4 is an enlarged fragmentary view of FIG. 2 showing, in combination, both the ductor blade unit and the dipping roller in conjunction with an ink reservoir.

The pivoted ductor-blade unit 12 shown diagrammatically in FIG. 1 is shown in an enlarged and more detailed view in FIG. 3. A cover plate 21 thereof is fastened to the underside of a sturdy main girder or cross-beam 20, and an edgewise disposed surface ductor blade 24 is fastened through the intermediary of a bearing girder or cross-beam 23 to a front side of the main girder 20. This ductor-blade unit 12 is covered or surrounded on all sides by a foil 25. In FIGS. 3 and 4, this foil 25 is shown somewhat spaced from the remaining structural parts of the ductor-blade unit 12 so as to be visible more clearly. In fact, the foil 25 adheres closely, of course, to the edgewise disposed surface ductor blade 24. A row of adjusting elements 26, only one of which is shown in FIGS. 3 and 4, are disposed on the cover plate 21 and fastened to the main girder 20, the row of adjusting elements 26 extending parallel to the inking cylinder 10, and the individual adjusting elements 26 being spaced at regular intervals from one another. The adjusting elements 26 are formed, respectively, of a cylinder 27 and a piston 28 having a spherical striker head 29 at the outer end thereof. The adjusting elements 26 are hydraulically actuated. The spherical impact or striker heads 29 engage the rear side of respective adjusting levers associated therewith. The adjusting levers 30 have a punctiform bearing support at an upper region thereof, as viewed in FIGS. 3 and 4. In bores formed in the bearing girder or cross-beam 23, threaded pins 31 with conical points ar screwed and project into conical seats 32 which are machined into the upper end of the adjusting levers 30. Compression springs 33 force the seats 32 constantly against the conical points of the threaded pins 31. These bearings ensure that the adjusting levers 30 can be pivoted, without auxiliary components, unequivocally in the direction of the metering region of the edgewise disposed surface ductor blade 24 by means of the striker heads 29.

The edgewise disposed surface ductor blade 24 is formed of a thin spring steel, for example 1 mm thick. The lower end thereof, as viewed in FIGS. 3 and 4, against which the adjusting surface 34 of the adjusting lever 30 presses, tangentially engages the outer cylindrical or casing surface 35 of the inking cylinder 10. The lower edge 36 of the edgewise disposed surface ductor blade 24 projects for a distance a beyond the point of tangency 19 to the outer cylindrical surface 35. While the ink film is metered in the tangentially engaging metering region of the surface ductor blade 24, the overhanging edge causes such a flow of the oncoming ink that dirt particles do not penetrate into the metering gap. As has been mentioned heretofore with respect to the embodiment of FIG. 1, the ink is fed via the dipping roller or ductor 14 to the inking cylinder 10.

A respective bearing block 40 and a respective adjusting or lock nut 41 are fastened to both ends of the ductor-blade unit 12 with the main girder 20. In non-illustrated side walls of the printing unit, journal pins 42 are provided which project into solid journal bearings of the bearing blocks 40. A set screw 43 is screwed at one end thereof into the adjusting nut 41 and, at the other end thereof, projects through a bore formed in a corresponding stationary adjusting nut 41 which is fastened to the non-illustrated side wall of the printing unit. By turning the set screw 43, the entire ductor-blade unit 12 can be swung about the bearing pin 42, on the one hand for adjusting it the distance a of the overhanging ductor-blade end and, on the other hand, for entirely removing the ductor-blade unit 12 from the outer cylindrical or casing surface 35 of the inking roller 10 for the purpose of cleaning it.

The ductor-blade unit 12 illustrated in FIG. 4 differs from that in FIG. 3 only by the addition of the ink reservoir 17. An ink trough 45 is fastened to the underside of the main girder 20 by screws 46 so that it is removable rather easily. In vicinity of the outer cylindrical surface 35 of the inking cylinder 10, the ink trough 45 has a packing washer 47. The trough 45 is filled with ink from a feeding tube 48 of an otherwise non-illustrated ink conveyer system, while discharge of the ink not entrained by the outer cylindrical surface 35 is effected by means of a discharge tube 49. The ink reservoir 17 filled with ink 50 is thus formed by the cover plate 21 of the ductor-blade unit 12, the ink trough 45 with the packing washer 47, the respective region of the outer cylindrical surface 35 rinsed by the ink and the lower edge 36 of the ductor blade 24. The flow conditions in vicinity of the edge 36 of the ductor blade 24, due to the adjustment of the ductor blade 24 by the distance a beyond the point of tangency 37, are such that, in fact, laminar flow of the ink transported by the outer cylindrical surface 35 prevails in the metering gap and nevertheless, dirt particles from the stripped-off ink are diverted in front of the edge 36 and, consequently, do not deposit in the metering gap.

As noted hereinbefore, the invention of the instant application is not limited to the embodiments described therein. For example, other ductor blades besides flat or surface ductor blades may be used, and the inking cylinder 10 need not necessarily have the same diameter as that of the other cylinders of the printing unit. On the contrary, the inking cylinder 10 may be operated equally efficiently with a smaller diameter. As mentioned hereinbefore, as well, the inking cylinder 10 may also be constructed as a screen roller with an edge ductor blade.

The foregoing is a description corresponding in substance to German Application No. P 33 29 331.7, dated Aug. 13, 1983, the International priority of which is being claimed for the instant application, and which is hereby made part of this application. Any material discrepancies between the foregoing specification and the aforementioned corresponding German application are to be resolved in favor of the latter.

I claim:

1. Convertible printing unit having impression, blanket and plate cylinders of like diameter, and an inking unit, having an applicator roller for feeding both dampening medium and ink, the applicator roller having a diameter equal to that of the impression, blanket and plate cylinders comprising an inking cylinder engageable with the applicator roller; said inking cylinder having a diameter equal to that of the impression, plate and blanket cylinders and the applicator roller; depending on the position of said blanket cylinder the plate cylinder and said inking cylinder being disposed relative to one another and to the blanket cylinder so that the blanket cylinder is selectively engageable with either the plate cylinder or said inking cylinder depending on the position of said blanket cylinder; the blanket cylinder being selectively coverable by a blanket or a rubber block; the applicator roller being separated from said inking cylinder in a given condition of the printing unit wherein the blanket cylinder is covered by the rubber block and is in direct cooperative engagement with said inking cylinder, the applicator roller and the blanket cylinder, in said given condition, being out of engagement with the plate cylinder.

2. Convertible printing unit according to claim 1 including another applicator roller having the same diameter as that of the cylinders and the first-mentioned applicator roller; said other applicator roller being connected via an ink distributor cylinder with the first-mentioned applicator roller, said other applicator roller being selectively in or out of engagement with the plate cylinder, said other applicator roller, in said given condition, being out of engagement with the plate cylinder.

* * * * *